US008668507B2

(12) United States Patent
Yang

(10) Patent No.: US 8,668,507 B2
(45) Date of Patent: Mar. 11, 2014

(54) LAMP HOLDER CONNECTOR

(75) Inventor: Mei-Chuan Yang, Taoyuan (TW)

(73) Assignee: Proconn Technology Co., Ltd., Taoyuan (TW)

( * ) Notice: Subject to any disclaimer, the term of this patent is extended or adjusted under 35 U.S.C. 154(b) by 202 days.

(21) Appl. No.: 13/345,664

(22) Filed: Jan. 6, 2012

(65) Prior Publication Data

US 2012/0302097 A1 Nov. 29, 2012

(30) Foreign Application Priority Data

May 27, 2011 (TW) ..... 100209554 A

(51) Int. Cl.
*H01R 33/02* (2006.01)

(52) U.S. Cl.
USPC ..... 439/226; 439/699.2

(58) Field of Classification Search
USPC ..... 439/226, 239, 620.02, 336, 182, 220, 439/224, 229, 232, 242, 243, 280, 356, 360, 439/366, 699.2, 734, 733.1, 753, 749, 581, 439/79, 540, 890, 490, 56, 562; 362/216, 362/376, 378; 174/17 R, 559
See application file for complete search history.

(56) References Cited

U.S. PATENT DOCUMENTS

| | | | | | |
|---|---|---|---|---|---|
| 2,120,879 | A * | 6/1938 | Wear et al. | ..... | 439/242 |
| 3,156,841 | A * | 11/1964 | Ayres | ..... | 313/49 |
| 4,005,922 | A * | 2/1977 | Burkhart et al. | ..... | 439/465 |
| 4,679,877 | A * | 7/1987 | Ahroni | ..... | 439/425 |
| 5,354,208 | A * | 10/1994 | Salaski et al. | ..... | 439/230 |
| 6,326,878 | B1 * | 12/2001 | Liang | ..... | 337/215 |
| 6,692,308 | B2 * | 2/2004 | Henrici et al. | ..... | 439/699.2 |
| 8,491,324 | B1 * | 7/2013 | Yang et al. | ..... | 439/226 |
| 2013/0178084 | A1 * | 7/2013 | Yang et al. | ..... | 439/236 |

* cited by examiner

*Primary Examiner* — Renee Luebke
*Assistant Examiner* — Harshad Patel

(57) ABSTRACT

A lamp holder connector includes a lower holder having a bottom board with two positioning pillars protruding upward thereon, and an upper holder covered on the lower holder to together define a receiving chamber. An electrical terminal is fastened in the receiving chamber, and has a base plate with two positioning holes opened therein for inserting the positioning pillars therein, and a pair of clamping plates connected with two opposite side edges of the base plate and facing each other for clamping one end of a lamp therebetween. A top end of each positioning pillar projects upward beyond a top side of the base plate and then is pressed downward by an external jig to have a deformation and form a blocking eave so as to tightly clip the base plate between the bottom board and the blocking eave.

6 Claims, 4 Drawing Sheets

LAMP HOLDER CONNECTOR

BACKGROUND OF THE INVENTION

1. Field of the Invention

The present invention generally relates to a connector, and more particularly to a lamp holder connector.

2. The Related Art

Generally, a conventional lamp holder connector includes an upper holder, a lower holder, and an electrical terminal. The upper holder and the lower holder are engaged with each other to define a receiving chamber therebetween. The electrical terminal is positioned in the receiving chamber by interfering with inner sidewalls of the upper holder and the lower holder. However, the electrical terminal is directly inserted in the receiving chamber without any fastening elements used to fasten the electrical terminal in the receiving chamber, so that often results in a tilted insertion of the electrical terminal in the receiving chamber. Furthermore, the electrical terminal is apt to deviate from original positions in the receiving chamber when the lamp holder connector is shaken.

SUMMARY OF THE INVENTION

An object of the present invention is to provide a lamp holder connector adapted for connecting with a lamp. The lamp holder connector includes a lower holder having a bottom board with at least two positioning pillars protruding upward on a front thereof and arranged along a front-to-rear direction, an electrical terminal fixed on the bottom board of the lower holder, and an upper holder. The electrical terminal has a base plate and a pair of clamping plates connected with two opposite side edges of the base plate and facing each other. At least two positioning holes are opened in the base plate along a front-to-rear direction. The positioning pillars of the lower holder are inserted in the positioning holes of the base plate respectively. A top end of each positioning pillar further projects upward beyond a top side of the base plate and then is pressed downward by an external jig to have a deformation and form a blocking eave so as to tightly clip the base plate between the bottom board and the blocking eave. The upper holder is covered on the lower holder. A receiving chamber is formed between the lower holder and the upper holder for receiving the clamping plates of the electrical terminal therein. One end of the lamp is inserted between the clamping plates in use, and the other end of the lamp is exposed outside the lamp holder connector.

As described above, the positioning pillars of the lower holder are inserted in the corresponding positioning holes of the base plate of the electrical terminal, and the top end of each positioning pillar further projects upward beyond the top side of the base plate and then is pressed downward by the external jig to have a deformation and form the blocking eave so as to tightly clip the base plate between the bottom board and the blocking eave. So, the electrical terminal can be firmly fastened to the lower holder, and working performance of the lamp holder connector is effectively assured.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
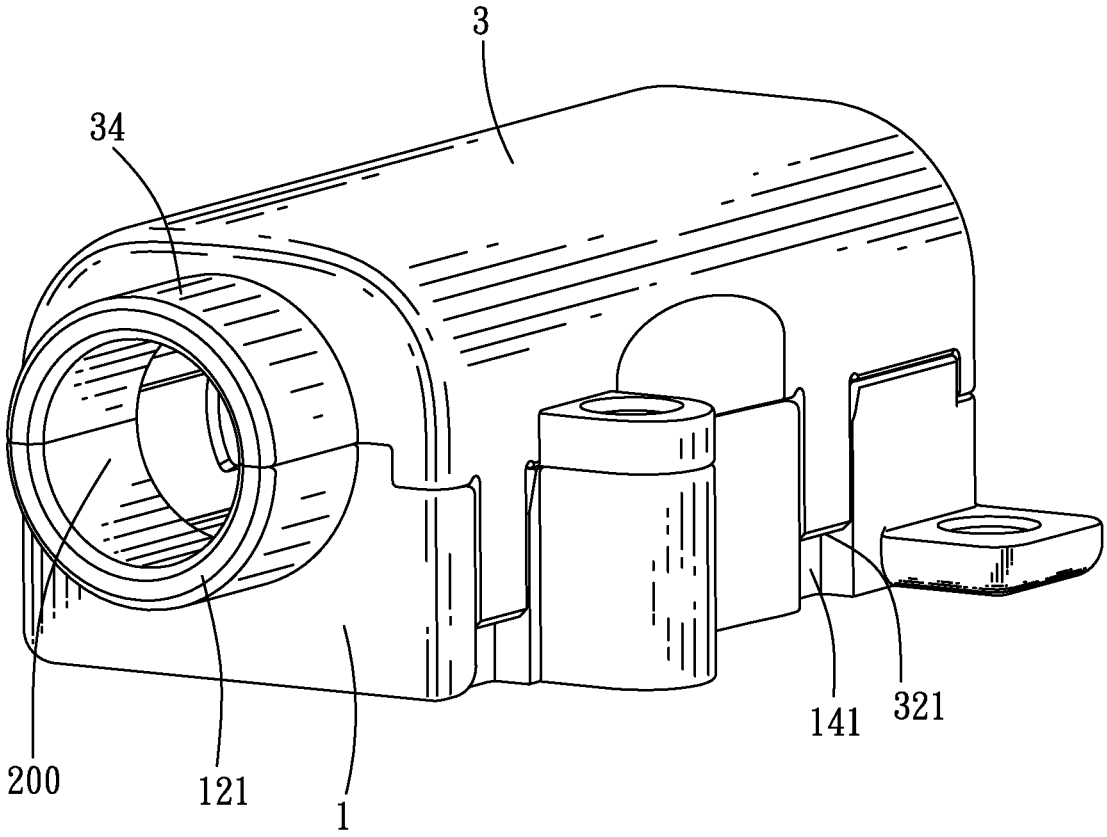
FIG. 1 is an assembled perspective view of a lamp holder connector according to an embodiment of the present invention.
Figure 2:
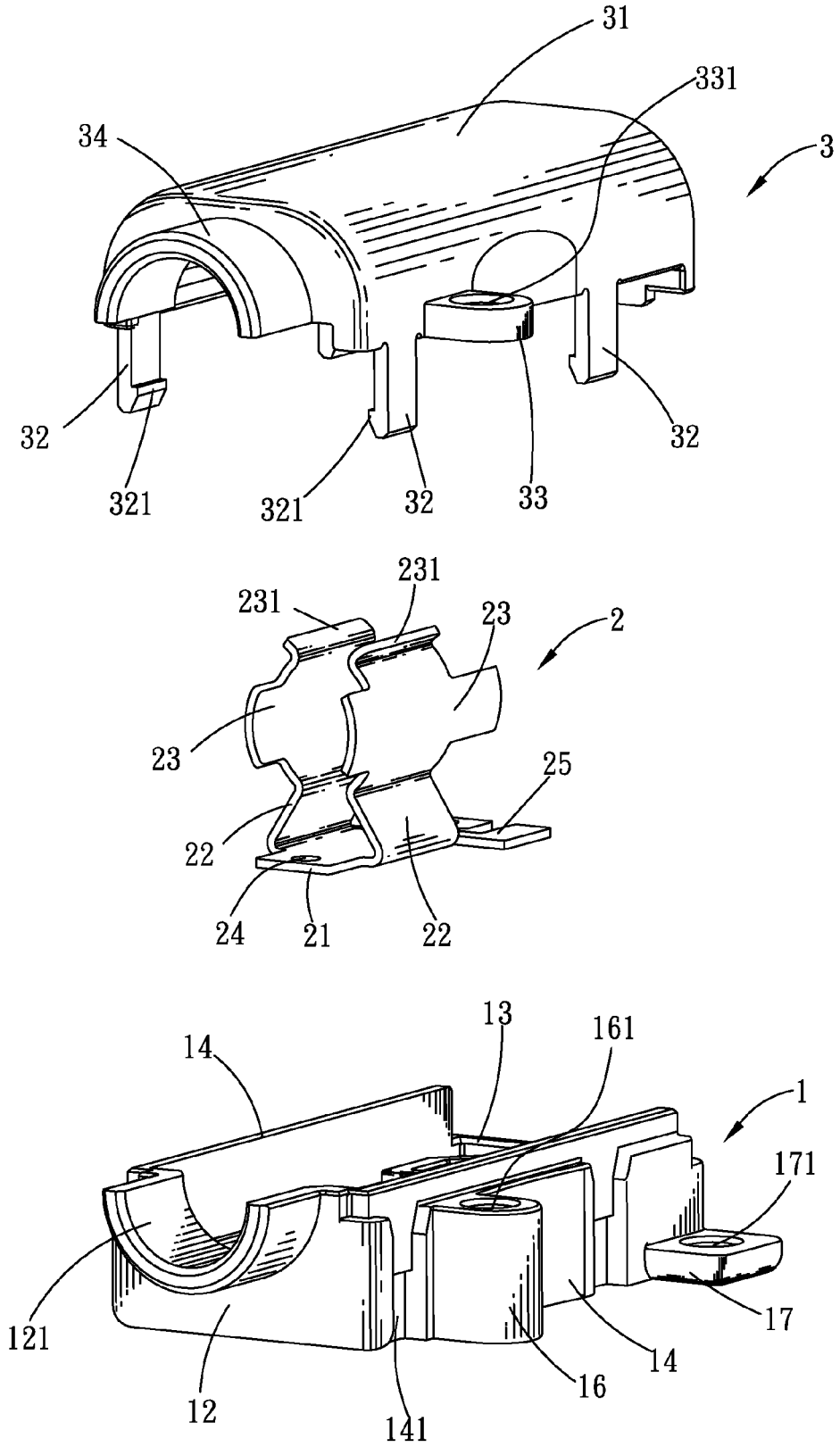
FIG. 2 is an exploded perspective view of the lamp holder connector of FIG. 1.
Figure 3:
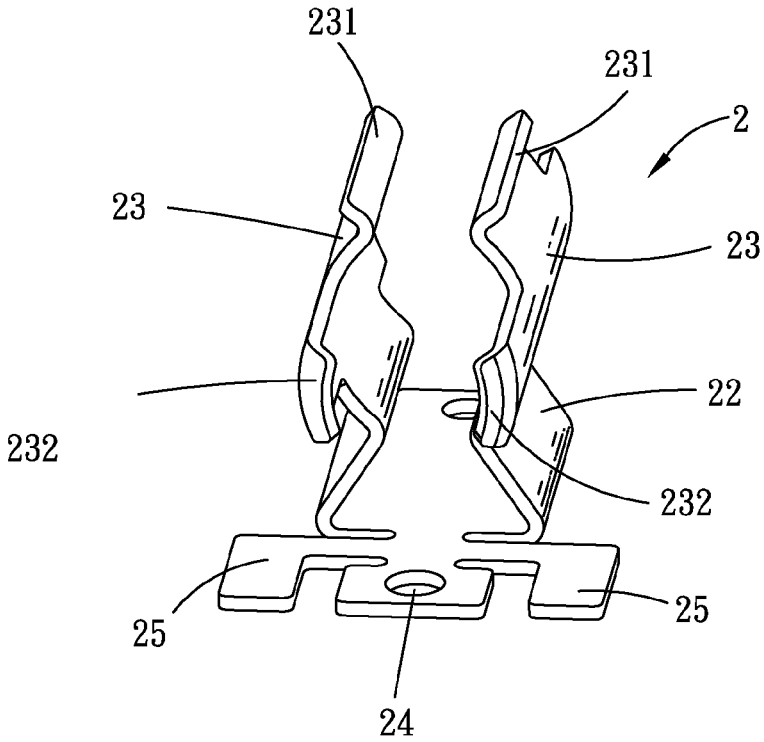
FIG. 3 is a perspective view of an electrical terminal of the lamp holder connector of FIG. 2.

With reference to FIG. 1 and FIG. 2, a lamp holder connector according to an embodiment of the present invention is adapted for connecting with a lamp (not shown) and a printed circuit board (not shown). The lamp holder connector includes a lower holder 1, an upper holder 3 and an electrical terminal 2.

Figure 4:
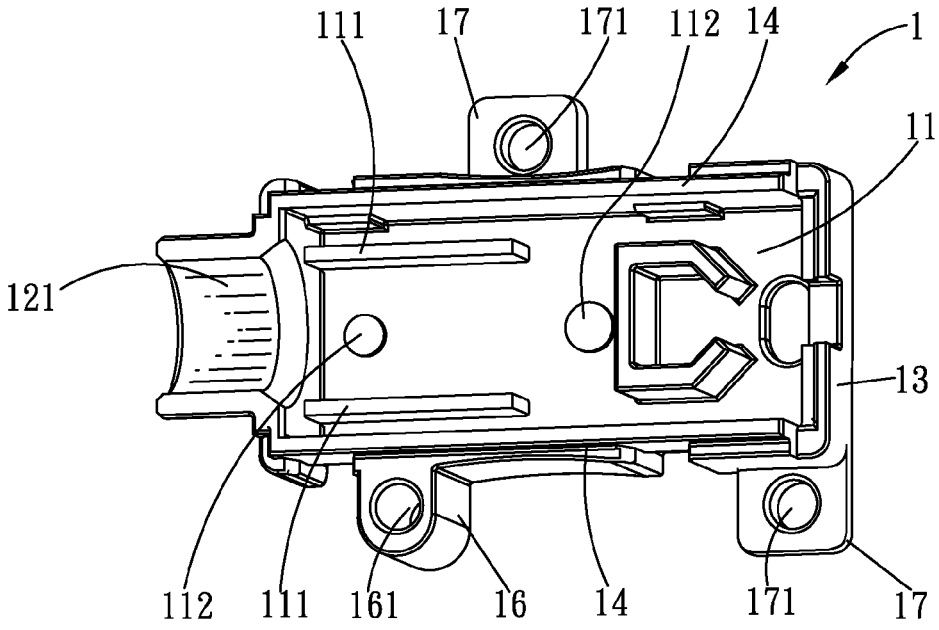
FIG. 4 is a perspective view of a lower holder of the lamp holder connector of FIG. 2.
Figure 5:
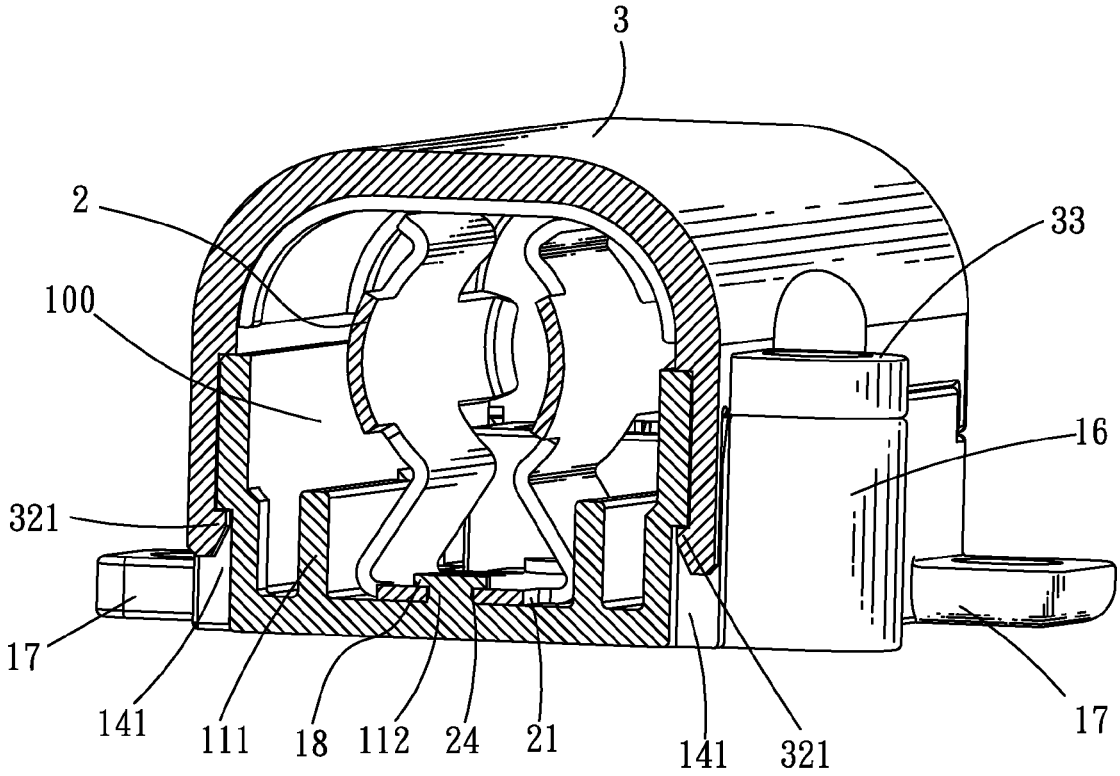
FIG. 5 is a sectional view of the lamp holder connector of FIG. 1.

Referring to FIG. 2, FIG. 4 and FIG. 5, the lower holder 1 has a bottom board 11 with at least two positioning pillars 112 protruding upward on a front thereof and arranged along a front-to-rear direction. The electrical terminal 2 is fixed on the bottom board 11 of the lower holder 1, and has a base plate 21 and a pair of clamping plates 23 connected with two opposite side edges of the base plate 21 and facing each other. At least two positioning holes 24 are opened in the base plate 21 along a front-to-rear direction. The positioning pillars 112 of the lower holder 1 are inserted in the positioning holes 24 of the base plate 21 respectively. A top end of each positioning pillar 112 further projects upward beyond a top side of the base plate 21 and then is pressed downward by an external jig (not shown) to have a deformation and form a blocking eave 18 so as to tightly clip the base plate 21 between the bottom board 11 and the blocking eave 18. The upper holder 3 is covered on the lower holder 1 to together define a receiving chamber 100 therebetween for receiving the clamping plates 23 of the electrical terminal 2 therein. In use, one end of the lamp is inserted between the clamping plates 23 of the electrical terminal 2, and the other end of the lamp is exposed outside the lamp holder connector.

Referring to FIG. 1 and FIG. 2, the lower holder 1 further has a front board 12, a rear board 13 and two side boards 14 protruding upward from a front end, a rear end and two opposite sides of the bottom board 11 respectively. A top of the front board 12 is concaved downward to define an arc-shaped mouth (not labeled) of which an inner periphery extends forward to form a lower inserting semi-barrel 121. The upper holder 3 has an arched cover body 31 and an upper inserting semi-barrel 34 protruding forward from a front sidewall of the cover body 31. The cover body 31 is covered on the lower holder 1 with the upper inserting semi-barrel 34 and the lower inserting semi-barrel 121 matching with each other to together define an inserting barrel 200 communicating with the receiving chamber 100 for positioning the lamp therein.

Referring to FIG. 1 and FIG. 2 again, two opposite outer sides of the side boards 14 of the lower holder 1 define a plurality of buckling fillisters 141. The outer side of one side board 14 further protrudes outward to form a fastening portion 16 with a fastening hole 161 vertically penetrating through a substantial middle thereof. Bottom edges of the cover body 31 of the upper holder 3 extend downward to form a plurality of buckling arms 32. A distal end of each buckling arm 32 protrudes inward to form a buckling barb 321 hooked in the corresponding buckling fillister 141 to secure the upper holder 3 and the lower holder 1 together. One sidewall of the cover body 31 of the upper holder 3 protrudes outward to form a fixing portion 33 with a fixing hole 331 vertically opened therein. The fixing portion 33 is located on the fastening portion 16 with the fixing hole 331 and the fastening hole 161 being vertically aligned with each other for inserting a fastening part (not shown) therein so as to further secure the upper holder 3 and the lower holder 1 together. A bottom of the outer side of each side board 14 of the lower holder 1 protrudes outward to form a latching portion 17 with a latching hole 171 vertically penetrating through a substantial middle thereof. A latching part (not shown) is inserted into the latching hole 171 to fasten the lamp holder connector on the printed circuit board.

Referring to FIGS. 2-5, a pair of supporting plates 22 is connected between the clamping plates 23 and the corresponding side edges of the base plate 21 and slanted towards each other. Two sides of the front of the bottom board 11 of the lower holder 1 protrude upward to form a pair of restricting boards 111 each extending in the front-to-rear direction with the positioning pillars 112 located therebetween. The supporting plates 22 of the electrical terminal 2 resist against inner sides of the restricting boards 111 of the lower holder 1. The clamping plates 23 of the electrical terminal 2 are oppositely arched outward to show an arced shape, and top ends thereof are obliquely bent outward to form a pair of guiding eaves 231 for guiding the one end of the lamp to be inserted downward between the clamping plates 23. Two rear edges of the clamping plates 23 are bent towards each other to form a pair of stopping tails 232 stopping against the one end of the lamp to prevent an excessive insertion of the lamp. A rear end of the base plate 21 of the electrical terminal 20 oppositely extends sideward to form a pair of connecting tails 25. A cable (not shown) is used to be connected between the connecting tails 25 and the printed circuit board to achieve an electrical connection of the lamp and the printed circuit board.

As described above, the positioning pillars 112 of the lower holder 1 are inserted in the positioning holes 24 of the base plate 21 of the electrical terminal 2, and the top end of each positioning pillar 112 further projects beyond the top side of the base plate 21 and then is pressed downward by the external jig to have a deformation and form the blocking eave 18 so as to tightly clip the base plate 21 between the bottom board 11 and the blocking eave 18. So, the electrical terminal 2 can be firmly fastened to the lower holder 1, and working performance of the lamp holder connector is effectively assured.

What is claimed is:

1. A lamp holder connector adapted for connecting with a lamp, comprising:

a lower holder having a bottom board, at least two positioning pillars protruding upward on a front of the bottom board and being arranged along a front-to-rear direction;

an electrical terminal fixed on the bottom board of the lower holder, the electrical terminal having a base plate and a pair of clamping plates connected with two opposite side edges of the base plate and facing each other, at least two positioning holes being opened in the base plate along the front-to-rear direction, the positioning pillars of the lower holder being inserted in the positioning holes of the base plate respectively, a top end of each positioning pillar further projecting upward beyond a top side of the base plate and then being pressed downward by an external jig to have a deformation and form a blocking eave so as to tightly clip the base plate between the bottom board and the blocking eave; and an upper holder covered on the lower holder, a receiving chamber being formed between the lower holder and the upper holder for receiving the clamping plates of the electrical terminal therein, one end of the lamp being inserted between the clamping plates in use and the other end of the lamp being exposed outside the lamp holder connector;

wherein a pair of supporting plates is connected between the clamping plates and the corresponding side edges of the base plate and slanted towards each other, two sides of the front of the bottom board protrude upward to form a pair of restricting boards, each extending in the front-to-rear direction with the positioning pillars located therebetween, and the supporting plates of the electrical terminal resist against inner sides of the restricting boards of the lower holder.

2. The lamp holder connector as claimed in claim 1, wherein the lower holder further has a front board, a rear board and two side boards protruding upward from a front end, a rear end and two opposite sides of the bottom board respectively, a top of the front board is concaved downward to define an arc-shaped mouth of which an inner periphery extends forward to form a lower inserting semi-barrel, the upper holder has an arched cover body and an upper inserting semi-barrel protruding forward from a front sidewall of the cover body, the cover body is covered on the lower holder with the upper inserting semi-barrel and the lower inserting semi-barrel matching with each other to together define an inserting barrel communicating with the receiving chamber for positioning the lamp therein.

3. The lamp holder connector as claimed in claim 2, wherein two opposite outer sides of the side boards of the lower holder define a plurality of buckling fillisters, bottom edges of the cover body of the upper holder extend downward to form a plurality of buckling arms, a distal end of each buckling arm protrudes inward to form a buckling barb hooked in the corresponding buckling fillister to secure the upper holder and the lower holder together.

4. The lamp holder connector as claimed in claim 2, wherein an outer side of one side board of the lower holder protrudes outward to form a fastening portion with a fastening hole vertically penetrating through a substantial middle thereof, one sidewall of the cover body of the upper holder protrudes outward to form a fixing portion with a fixing hole vertically opened therein, the fixing portion is located on the fastening portion with the fixing hole and the fastening hole vertically aligned with each other for inserting a fastening part therein so as to secure the upper holder and the lower holder together.

5. The lamp holder connector as claimed in claim 1, wherein the clamping plates of the electrical terminal are oppositely arched outward to show an arced shape, top ends of the clamping plates are obliquely bent outward to form a pair of guiding eaves for guiding the one end of the lamp to be inserted downward between the clamping plates.

6. The lamp holder connector as claimed in claim 5, wherein two rear edges of the clamping plates are bent towards each other to form a pair of stopping tails stopping against the one end of the lamp to prevent an excessive insertion of the lamp.

* * * * *